United States Patent [19]

Roberts

[11] 4,104,061

[45] Aug. 1, 1978

[54] POWDER METALLURGY

[75] Inventor: Sidney G. Roberts, Livermore, Calif.

[73] Assignee: Kaiser Aluminum & Chemical Corporation, Oakland, Calif.

[21] Appl. No.: 734,575

[22] Filed: Oct. 21, 1976

[51] Int. Cl.[2] ..... B22F 3/00

[52] U.S. Cl. ..... 75/211; 75/226

[58] Field of Search ..... 75/200, 211, 226

[56] References Cited

U.S. PATENT DOCUMENTS

| | | | |
|---|---|---|---|
| 3,384,481 | 5/1968 | Broverman | 75/226 |
| 3,698,962 | 10/1972 | Kasak et al. | 75/226 |
| 3,700,435 | 10/1972 | Chandhok | 75/226 |
| 3,728,111 | 4/1973 | Stromblad et al. | 75/226 |
| 3,954,458 | 5/1976 | Roberts | 148/126 |

*Primary Examiner*—Brooks H. Hunt

*Attorney, Agent, or Firm*—Paul E. Calrow; Edward J. Lynch

[57] ABSTRACT

The invention relates to an improved method of removing gaseous or volatile contaminants from metal powders or porous compacts thereof wherein the powder or compact is subjected to a procedure comprising vacuum treatment, back filling with an innocuous depurative gas and another vacuum treatment to remove gaseous contaminants and depurative gas. The evacuation and back filling steps are usually repeated several times. Preferably, the depurative or wash gas is one which is capable of reacting with the metal powder or alloy constituents thereof to form a solid reaction product. After the gaseous and/or volatile contaminants are removed, the powder or compact is compressed to full density and then subjected to additional fabrication, if so desired. The decontamination procedures of the invention can reduce the volatile and gaseous contaminants to such low levels that essentially no porosity is developed in the powder metallurgical products during subsequent high temperature working or thermal treatments even if the temperatures of such treatments are higher than the decontamination temperatures. As a result, improved microstructure, strength and toughness are attained in the final product.

36 Claims, 1 Drawing Figure

POWDER METALLURGY

BACKGROUND OF THE INVENTION

Figure 1:
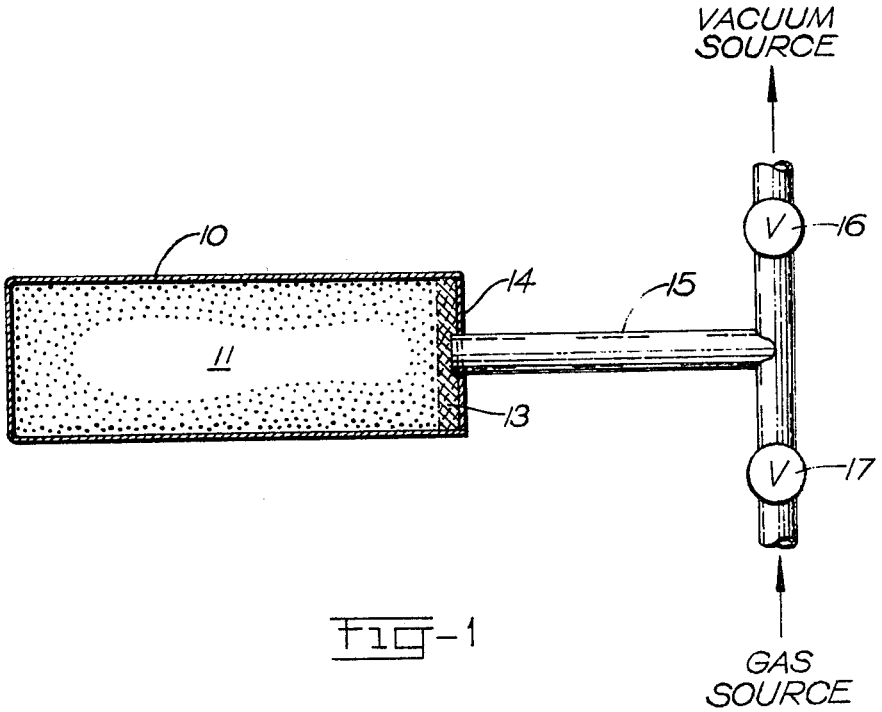

This invention generally relates to the manufacture of powder metallurgical products and is specifically directed to an improvement in the techniques used in degassing or decontaminating the powder or porous compacts made from such powder.

The degassing or decontamination of powdered metals to remove volatile or gaseous contaminants such as water vapor and hydrogen is necessary when forming high quality powder metallurgical products. The surfaces of powdered metal particles usually contain both chemically and physically combined moisture and other gaseous or volatile contaminants which can cause internal porosity during subsequent high temperature processing and consequently degrade the ultimate wrought powder metallurgical product.

Prior art degassing procedures, particularly for aluminum base powders, generally emphasize a very high temperature treatment to remove both the physically and chemically sorbed water and other contaminants before the final densification of the powder mass. As a general rule, the degassing temperature was higher than any subsequent temperature the powder metallurgical product is exposed to. Usually, during the high temperature degassing treatment the powdered metal or porous compact is also subjected either to a vacuum treatment or flushed with a flowing inert gas to assist in the removal of the gaseous contaminants. However, neither method has been entirely satisfactory.

Evacuation of the powdered mass to the desired low pressure level at a modest temperature necessitated extensive treatment time which adds considerably to the expense and inconvenience in the manufacture of powder metallurgical products. Also, with large volumes of powder or large compacts thereof it is nearly impossible to develop the low pressures necessary for effective decontamination throughout the entire powdered mass. Additionally, exposure to very high temperature during evacuation has been found to agglomerate the alloying constituents present in prealloyed powder particles which negates to a certain extent a major advantage of powder metallurgy, namely, the uniform dispersion of second phase alloy constituents in an extremely fine form throughout the base metal matrix.

Flushing the powder mass with an inert gas can be less time consuming that vacuum treatments but it is often less effective because the gas tends to channel through the powdered mass leaving portions of the powder or compact poorly flushed. Moreover, the flushing procedures with inert gas can leave significant amounts of the inert gas in the pores of the powdered metal body which can eventually cause porosity in the final manufactured product.

Roberts in U.S. Pat. No. 3,954,458 suggested evacuation of the powder to low pressure levels at an intermediate temperature range of about 450° to 850° F (232°–455° C), preferably about 600° to 800° F (316°–427° C), to remove water, hydrogen and other contaminants from powdered aluminum or an unsintered compact thereof so as to avoid agglomeration of the alloying constituents. While the process described is effective in producing high quality, powder metallurgical products, the process did not reduce the length of time necessary to effectively decontaminate the powder or the compact.

Working a powdered mass can significantly reduce the porosity resulting from any gaseous contaminants present but any subsequent exposure to high temperature will tend to regenerate the porosity. With prior decontamination procedures, particularly as applied to aluminum powders, it was very difficult to reduce the contaminant level to the point where essentially no porosity (visible at 1000X magnification) developed after exposure to temperatures above the solidus temperature of the alloy.

It is against this background that the present invention was developed.

DESCRIPTION OF THE INVENTION

This invention generally relates to the method of producing powder metallurgical products and is specifically directed to improved procedures to remove volatile and gaseous contaminants from a metal powder or a porous compact thereof. The process of the invention essentially eliminates porosity in the final product, particularly after thermal treatments, such as annealing or solution heat treatment and aging and also reduces the time necessary for effective decontamination.

In accordance with the invention the metal powder or a porous compact thereof, is subjected to a vacuum at elevated temperatures, infused with a depurative gas, preferably one which is capable of forming a solid reaction product with the metal, the alloying constituents of the metal or impurities in the metal and then again subjected to a vacuum treatment to remove the infused gas along with the gaseous contaminants. Usually, the steps of evacuation and back filling with the depurative or wash gas are repeated several times, preferably about 3–15 times, to reduce the volatile and gaseous contaminants to the low levels desired in high quality, powder metallurgical products. The last step in decontamination procedures should be a vacuum treatment to remove substantially all of the residual gas from the powder or the powdered compact. However, the last vacuum treatment may be unnecessary if the depurative gas forms a solid reaction product with the metal matrix, alloying constituents or impurities, and if the decontaminated metal is to be subsequently worked.

After decontamination the powdered metal or the porous compact is compressed to full density (usually at elevated temperatures) and then may be worked in a suitable manner such as by forging, extruding or rolling. Full density, as used herein, refers to a density greater than 90% of the theoretical density of the metal. If the powder or compact contains a depurative gas which is capable of reacting with the metal matrix or alloying constituents, it will do so when compressing to full density or during other working operations due to the development of reactive nascent metal surfaces during such procedures. Moreover, the solid reaction product is dispersed throughout the metal matrix by the working so as to not detrimentally affect the properties of the final wrought product. If the full density powdered metal compact is extruded to final form the extrusion ratio should be in excess of 5:1 preferably greater than 7:1 for sound, high quality powder metallurgical products. Similarly, if the full density powdered compact is to be rolled, it should be reduced in thickness at least 25%, preferably more than 50%. If forged the reduction should be at least 25%, preferably more than 50%.

The vacuum levels utilized with the decontaminating procedures of the invention generally can range from about 5 to about $10^{-7}$ torr (1 torr = 1 mm Hg at 0° C). The initial evacuation step can be terminated at a relatively high pressure (e.g. 1 torr), but the terminal pressure in each successive evacuation is usually at decreasingly lower levels. In the final vacuum treatment the terminal pressure should be less than 0.5 torr, preferably less than 0.1 torr for effective removal of the contaminants which are gaseous under those conditions. Generally, vacuum treatment times will depend upon size, shape, porosity and temperature of the powdered mass. As used herein pressure refers to the vacuum system pressure not the pressure within the powder or compact. The pressure within the powder or compact depends upon the particle size of the metal, the porosity, etc. and may be considerably higher than the system pressure.

Temperatures of the powder or compact during evacuation should be in excess of 400° F (205° C) preferably greater than 500° F (260° C) but less than the melting point of the metal. However, the particular temperature used depends upon the metal being degassed. For aluminum and aluminum alloys temperatures of about 400° to 1200° F (205° C–649° C), preferably about 500° to 1000° F (250°–538° C) give excellent results.

Back filling with the depurative gas is best effected at atmospheric pressure, although superatmospheric and subatmospheric pressure can be utilized. The temperature of the powder or porous compact during treatments with the depurative gas should be above 400° F (205° C) but less than the melting point of the metal and generally will follow the limits set for vacuum treatments. The gas treatment also appears to minimize temperature gradients throughout the powdered mass which further facilitates decontamination.

Suitable gases include nitrogen, hydrogen, argon, helium and the like. Gas mixtures can be used and each gaseous treatment need not use the same gas. For example, hydrogen gas could be used for one or more treatments to reduce metal oxides in the powder or compact to the base metal and in subsequent gaseous treatment inert gases such as argon or helium could be used to remove the gaseous or volatile contaminants. The depurative gas selected should be contaminant free and should not form reaction products which are highly deleterious to the final product.

It is preferred to select a depurative gas which forms an innocuous solid reaction product with the metal, alloying constituents and the like. This reduces the vacuum treatment requirements and in some cases can eliminate the necessity for a final vacuum treatment before compressing to full density.

A nitrogen containing gas is particularly attractive for treating aluminum and aluminum alloys because it is believed the residual nitrogen forms an aluminum nitride (a solid reaction product) which can be readily dispersed throughout the aluminum matrix by working. The nitrogen containing gas should contain more than 50% (by volume) nitrogen, preferably all nitrogen. Liquid nitrogen is an excellent source for nitrogen because the delivered gas is dry and free of contaminants.

The invention is suitable for use with most powdered metals but it is particularly suitable for aluminum and aluminum alloys, particularly high strength aluminum alloys which have finely divided alloying constituent uniformly dispersed throughout the aluminum matrix. Typical aluminum alloys are given in the table below.

| | Prealloyed Aluminum Powder Compositions - Weight Per Cent | | | | | | | | | | | |
|---|---|---|---|---|---|---|---|---|---|---|---|---|
| Alloy System | % Si | % Fe | % Cu | % Mn | % Mg | % Cr | % Ni | % Zn | % Ti | % Zr | % Co | % Al |
| Al-Zn-Mg | Up to 1.5* | Up to 3.5* | Up to 4.0 | Up to 3.0* | 0.50 to 4.5 | Up to 2.0* | Up to 3.5* | 5.0 to 13.0 | Up to 1.0* | Up to 1.5* | Up to 2.5* | Bal |
| Al-Cu | Up to 2.0* | Up to 4.0* | 1.0 to 7.5 | Up to 4.0* | Up to 5.0* | Up to 2.0 | Up to 4.0* | Up to 5.0* | Up to 1.0 | Up to 1.5* | Up to 3.5* | Bal |
| Al-Mg | Up to 1.0* | Up to 5.0* | Up to 1.0* | Up to 4.5* | 1.0 to | Up to 3.0* | Up to 4.0* | — | Up to 2.0* | Up to 3.0* | Up to 5.0* | Bal |
| Al-Mn | Up to 1.0* | Up to 3.5* | Up to 2.5* | 1.5 to 10.0 | Up to 3.0* | Up to 1.0* | Up to 4.0* | — | Up to 2.0* | Up to 4.0* | Up to 4.0* | Bal |
| Al-Fe | Up to 1.0* | 2.5 to 12.0 | — | Up to 4.0* | Up to 3.0* | Up to 3.0* | Up to 5.0* | — | Up to 2.5* | Up to 2.5* | Up to 5.0* | Bal |
| Al-Si | 2.0 to 30.0 | Up to 3.5* | Up to 5.0* | Up to 6.0* | Up to 4.0* | Up to 1.0* | Up to 4.0* | Up to 3.0* | Up to 2.0* | Up to 4.0* | Up to 4.0* | |

*Ancillary alloy additions, with the total ancillary alloy additions not exceeding 10.0%, preferably not exceeding 5.0%.

In addition to the alloying elements described above the aluminum alloys may also contain up to 5% of elements selected from the group consisting of vanadium, niobium, tantalum, scandium and rare earth elements. However, the total ancillary alloying elements should not exceed 10%, preferably not more than 5%.

The Al-Zn-Mg alloys described in the above table are particularly attractive due to the capability of being solution heat treated and aged to extremely high tensile properties. Attendant with these high tensile properties are outstanding ratios of notch tensile strength and yield strength when such products are degassed to the extremely low contaminant levels the present process is capable of reaching.

The aluminum powder can be conveniently prepared as a prealloyed powder by atomizing the alloy in a suitable gaseous medium such as air or a mixture (by volume) of 94% nitrogen and 6% oxygen, and the particle size of the metal powder should be less than 100 mesh (0.147 mm maximum) in size although the process of the invention can be used with metal particulate as large as 0.25 inch (0.64 cm) in maximum dimension. The loose aluminum powder can be decontaminated as is or compacted into a porous mass prior to decontamination.

To decontaminate aluminum alloys containing significant quantities of alloying constituent uniformly dispersed throughout the aluminum matrix, the temperature of the metal should be maintained relatively low or the treatment times shortened to avoid agglomeration of the alloying constituent as described and claimed by Roberts in U.S. Pat. No. 3,954,458. However, due to the fact that the present invention allows for a significant reduction in the degassing time, decontamination temperatures higher than those described by Roberts in U.S. Pat. No. 3,954,458 can be utilized without significant agglomeration of the dispersed alloy phases.

With relatively high pressure, such as is found during the initial portion of an evacuation period, gas flow out of the powdered metal or compact is viscous in nature and the removal of gaseous contaminants is quite rapid. However, as the pressure is lowered, the gas flow regime gradually changes from a viscous flow to a molecular flow. Removal of gaseous contaminants when the gas flow is in the molecular flow regime is more or less by random capture by the evacuation system and therefore extremely slow. However, by subjecting the powder or compact to a plurality of evacuation treatments followed by back filling with a depurative gas as in accordance with the invention, the volatile and/or gaseous contaminants are rapidly removed under essentially viscous flow conditions. Extremely low contaminant levels can be reached very quickly by this process, much more quickly than with prior art procedures.

The final step in the decontamination procedure should be a vacuum treatment to remove any residual gas. However, a final vacuum treatment may not be necessary if the depurative gas forms a solid reaction product with the powdered metal and if the decontaminated product is to be worked.

In accordance with a preferred decontamination procedure of the invention, the powdered metal or the porous compact is placed in a suitable closed metallic container or canister having an outlet connected to a vacuum system and a gas source. If desired separate outlets for the vacuum system and the gas source can be provided. After decontamination the outlet or outlets from the canister are closed so that the powder or compact can be compressed to full density within the container without exposing the degassed metal to possible sources of contamination. The canister can be removed from the compressed powder prior to subsequent fabrication by scalping or other suitable means. If the powder is not compacted prior to degassing it is preferred to subject the loose powdered metal to vibration in the canister to ensure a powdered mass of maximum loose fill density. However, if a compact is used it should be porous and have a density less than 90%, preferably less than 80% of full density for effective removal of gaseous contaminants.

FIG. 1 illustrates a suitable arrangement for degassing a mass of powdered metal. A metallic canister 10 is shown containing a mass 11 of powdered metal. A fibrous metal pad 13 (e.g., steel wool) is provided at the end 14 of the canister to prevent escape of powdered metal during evacuation. Alternatively, the steel wool pad can be replaced with a porous compacted mass of the powdered metal. The conduit 15 is fixed to the end 13 of canister 10 and is in fluid communication with a vacuum source and a gas source. Suitable valves 16 and 17 are provided so that the powdered metal in the canister can be alternately subjected to vacuum treatment and then back filling with the gas.

Treatment times for degassing can vary considerably depending upon the contaminant level desired in the final product and on the size, shape and density of the powdered metal mass. For large masses of powdered metal or large compacts it may be desirable to provide relatively large internal passageways in the powdered mass to reduce the time necessary to attain uniformly low pressures throughout the powdered mass. When decontaminating a porous compact such passageways can be formed during compaction by established methods such as by placing removable rods in the powder prior to isostatic compaction. When decontaminating uncompacted powder, compacted porous tubes of the powdered metal can be positioned in the powdered metal in the canister prior to treatment have been found to be satisfactory. Such passgeways facilitate the decontamination of the powder but their presence requires care during compression after decontamination to ensure complete densification. Treatment times for decontamination in accordance with the invention are considerably less than prior art procedures and, moreover, the process is capable of reaching contaminant levels heretofore impossible with the prior practices.

The following examples are given to further illustrate the invention. The aluminum powder used in Examples I–IV was a prealloyed aluminum powder having a nominal composition of 9% zinc, 2.5% magnesium, 1.25% copper, 0.6% cobalt and 0.2% zirconium and the balance essentially aluminum. The particle size of the aluminum powder was −100 mesh.

EXAMPLE I

An aluminum canister 4⅜ inches (11.1 cm) in diameter and about 18 inches (45.8 cm) long was filled with the powdered aluminum and subjected to vibration to compress the loose powder. A cover plate with an evacuation tube was welded to the end of the canister and the evacuation tube was connected to a vacuum source. The canister was initially subjected to a vacuum of about 1 torr (system pressure) at room temperature and heated to a temperature of about 700° F (371° C). While maintaining this temperature, evacuation was continued for about 25 hours with the final system vacuum level at $2 \times 10^{-7}$ torr. The canister was sealed by crushing the evacuation tube and then the powdered aluminum in the canister was immediately compressed to full density in a closed extrusion press heated to 650° F (343° C). The canister was scalped from the compressed powdered compact after which the compressed compact was extruded at 650° F (343° C) with an extrusion ratio of 20:1. This process generally followed prior procedures. Metallographic examination of extruded specimens which had been heated for one hour at temperatures between 800° and 1050° F (427°–566° C) and quenched in cold water indicated excessive porosity.

EXAMPLE II

A second canister containing the aluminum powder was prepared and filled as described above in Example I, except that the evacuation tube was also connected to a nitrogen source (liquid nitrogen). The canister was evacuated at room temperature to an initial system pressure of about 1 torr and then heated to about 500° F (260° C) with continued evacuation. The powder was back filled at atmospheric pressure with very dry nitrogen from the liquid nitrogen source, and then subjected to an additional vacuum treatment at a lower pressure with the temperature increased to 700° F (371° C). The evacuation and nitrogen flush procedures were repeated nine more times over a period of 5 hours. The final evacuation lasted for about 2 hours, and the final system pressure was $9.6 \times 10^{-7}$ torr. The total degassing procedure took 8.75 hours. The decontaminated powder was compressed to full density and extruded as described in Example I. Metallographic examination of the extruded specimens which had been heated for one hour at temperatures between 800°-1050° F (427°-566° C) and quenched in cold water indicated essentially no visible porosity at 1000X magnification. Moreover, the extrusions had excellent combinations of strength and ductility after solution heating at 880° F (471° C), quenching, aging at 260° F (127° C) for 24 hours and then aging at 325° F (163° C) to a −T7 type temper. For example, in the longitudinal direction the tensile strength was 95.4 ksi, the yield strength was 91.4 ksi, the percent elongation (in 4d) was 10.4% and the percent reduction in area was 23%. In the transverse direction the tensile strength was 90.9 ksi, the yield strength was 87.2 ksi, the elongation in 2d was 10.0% and the percent reduction in area was 15%.

EXAMPLE III

Two billets were prepared from the prealloyed aluminum powder, one by the method described above in Example II, except that the final degassing temperature was 850° F (455° C) and the other billet by compacting the powder to a density of about 60% of full density and then degassing the compact in the same manner as the other billet. After degassing the powder and porous compacts were compressed to full density billets, scalped to remove the canister and then extruded with a 20:1 extrusion ratio as described above in Example II. Specimens of both extruded billets were heated for 1 hour at 880°, 900°, 925°, 975° and 1050° F (471°, 482°, 496°, 524° and 566° C), to determine the extent of any gaseous contaminants in the extruded specimens. Specimens which had been heated at 800°, 900° and 925° F showed no visible porosity by optical microscopy at 1000X magnification. The extruded specimen formed from the porous compact which had been heated at 975° F showed melting and a few small pores and some melting. The extruded specimen from the billet formed from uncompacted powder which had been heated at 975° F showed no identified porosity at 1000X after heating at 975° F although some melting was noted. Specimens of both billets showed extensive melting and attendant porosity after heating at 1050° F.

EXAMPLE IV

Three extruded specimens of Example III from the uncompacted powder billet were solution heated at 880° F (471° C) for 1 hour, quenched in water and then heated at 250° F (127° C) for 24 hours to obtain a −T6 type temper. Two of the specimens were further heated to 325° F (163° C) and held at that temperature for 6 and 10 hours, respectively, to obtain −T7 tempers. Some mechanical properties of the several specimens are set forth below.

| Tempers | YS,ksi | NTS,ksi | NTS/YS |
|---|---|---|---|
| −T6 | 106.2 | 114.1 | 1.07 |
| −T7(6 hrs) | 94.6 | 119.3 | 1.26 |
| −T7(10 hrs) | 89.8 | 115.9 | 1.29 |

The ratio of notch tensile strength to yield strength generally is a good indication of the fracture toughness of the material and from the above data it is evident that the fracture toughness of these specimens is quite high for the strength levels indicated. It is believed that the notch tensile strength to yield strength ratio of 1.26 at a yield strength of essentially 95,000 psi as indicated above has heretofore never been obtained with any aluminum alloy. The notched tensile strength to yield strength ratios of 1.07 to 1.29 at yield strength levels of 106,000 and 89,800, respectively, are also outstanding values. While these properties are outstanding, the examples are given to illustrate the advantages of the process. No attempt was made to optimize the alloy composition which would undoubtedly provide even better results.

EXAMPLE V

Two −100 mesh prealloyed aluminum powders were prepared containing, respectively, 5.2% Mg, 1.25% Cr and the balance essentially aluminum and 5.2% Mg, 0.75% Mn, 0.75 Cr and the balance essentially aluminum. The powders were decontaminated and compressed to full density billets in accordance with the method described in Example III with the terminal pressure of $10^{-6}$ torr. The billets were heated to 750° F and then extruded with a 30:1 extrusion ratio. The tensile properties of the extrusions as extruded (−F temper) were as follows:

| Alloy | Direction | T.S.(ksi) | YS (ksi) | % Elong. in 1.0 inch |
|---|---|---|---|---|
| AlMgCr | Long. | 68.8 | 47.6 | 16.0 |
| | Trans. | 68.1 | 48.3 | 17.0 |
| AlMgMnCr | Long. | 64.0 | 41.4 | 18.0 |
| | Trans. | 63.4 | 41.4 | 18.0 |

As a comparison specimens similarly extruded of 5% Mg aluminum billets which had been D.C. cast in a conventional fashion would have yielded strengths less than 25 ksi. Extruded specimens of both alloy compositions were GMA (MIG) welded with 3/64 inch diameter filler wire of 5183 aluminum alloy (Aluminum Association alloy designation). The welded specimens exhibited essentially no porosity in the fusion zone of the base metal which indicates extremely low gaseous contaminant levels. Moreover, no recrystallization of the base metal was evident in the heat-affected zone.

As used herein all percent compositions refer to weight percent unless noted otherwise. Reference to solution heat treating includes solution heating to bring soluble constituents into solid solution and quenching such as in air, water or other medium. Annealing includes both stress relieving and recrystallization.

It is obvious that various modifications and improvements can be made to the present invention without departing from the spirit thereof and the scope of the appended claims.

What is claimed is:

1. A method of preparing essentially porosity free powder metallurgical products comprising:

(a) subjecting powdered metal or a porous compact thereof to a plurality of treatment cycles to remove volatile and gaseous contaminants, each of said cycles comprising a vacuum treatment of the powder or compact followed by infusion thereof with a depurative gas;

(b) controlling the temperature of the environment surrounding the powder or compact during said treatment cycles to above 400° F and increasing said temperature during said cycles so that upon completion of the treatment cycles the temperature of the powder or compact is essentially at the desired level for compacting;

(c) developing a pressure of less than 5 torr during each vacuum treatment and maintaining the pressure during at least one of the vacuum treatments following the initial treatment cycle at a level sufficiently below 5 torr to remove essentially all volatile and gaseous contaminants from the powder or compact; and (d) compacting the powder or compact to essentially full density.

2. The method of claim 1 wherein the powdered metal or porous compact is subjected to at least 3 cycles of vacuum treatment and infusion with the depurative gas.

3. The method of claim 1 wherein the pressure during the additional vacuum treatments is less than 0.5 torr.

4. The method of claim 3 wherein the pressure during at least one of the additional vacuum treatments is less than 0.1 torr.

5. The method of claim 1 wherein the porous powder metal compact has a density of less than 90% of full density.

6. The method of claim 5 wherein the porous powder metal compact has a density of less than 80% of full density.

7. The method of claim 1 wherein the depurative gas is capable of forming a solid reaction product with the metal.

8. The method of claim 1 wherein the depurative gas is capable of reducing a metal oxide in the powdered metal or porous compact.

9. The method of claim 8 wherein the reducing depurative gas is hydrogen.

10. The method of claim 1 wherein said depurative gas is selected from the group consisting of argon, helium, nitrogen, hydrogen and mixtures thereof.

11. The method of claim 1 wherein the metal powder or porous compact thereof is formed from aluminum or an aluminum alloy.

12. The method of claim 11 wherein the depurative gas contains at least 50% by volume nitrogen.

13. The method of claim 11 wherein the depurative gas is essentially all nitrogen.

14. The method of claim 11 wherein the source for the nitrogen gas is liquid nitrogen.

15. The method of claim 11 wherein the temperature of the powder or compact in the vacuum and the gas infusion treatments is between about 400° and 1050° F.

16. The method of claim 11 wherein the temperature of the powder or compact in the vacuum and the gas infusion treatments is from about 500°–900° F.

17. The method of claim 11 wherein the powdered metal or porous compact thereof is prealloyed aluminum powder.

18. The method of claim 17 wherein the prealloyed aluminum powder is an alloy selected from the group of alloy compositions consisting of:

A. an Al-Zn-Mg alloy consisting essentially of about 5 to 13% Zn, about 0.50 to 4.5% Mg, not more than about 10% ancillary alloying additions and the balance aluminum and inconsequential amounts of impurities;

B. an Al-Cu alloy consisting essentially of about 2.5 to 7.5% Cu, not more than about 10% ancillary alloying additions and to balance aluminum and inconsequential amounts of impurities;

C. an Al-Mn alloy consisting essentially of about 1.50 to 10% Mn, not more than about 10% ancillary alloying additions and the balance aluminum and inconsequential amounts of impurities;

D. an Al-Fe alloy consisting essentially of about 4.0 to 12.0% Fe, not more than about 10% ancillary alloying additions and the balance aluminum and inconsequential amounts of impurities;

E. an Al-Mg alloy consisting essentially of about 2 to about 10% Mg, not more than 10% ancillary alloying additions and the balance aluminum and inconsequential amounts of impurities; and F. an Al-Si alloy consisting essentially of about 2.0 to about 30.0% Si, not more than 10% ancillary alloying additions and the balance aluminum and inconsequential amounts of impurities.

19. The method of claim 18 wherein the decontaminated Al-Zn-Mg alloy powder is compressed to full density, fabricated into a semifinished product, solution heat treated and aged.

20. The method of claim 18 wherein the decontaminated Al-Mg alloy is compressed to full density and fabricated into a semifinished product.

21. The product formed by the method of claim 19.

22. The method of claim 1 wherein the decontaminated metal powder or compact is compressed to an essentially full density ingot or billet.

23. The method of claim 22 wherein the ingot or billet is subjected to further working to a semifinished form.

24. The method of claim 23 wherein the semifinished form is subjected to thermal treatment.

25. The method of claim 24 wherein the thermal treatment is solution heat treatment and aging.

26. The method of claim 25 wherein the thermal treatment is annealing.

27. The method of claim 23 wherein the ingot or billet is extruded with an extrusion ratio of greater than 5:1.

28. The method of claim 27 wherein the extrusion ratio is greater than 10:1.

29. The method of claim 23 wherein the ingot or billet is rolled with a reduction in thickness of greater than 25%.

30. The method of claim 29 wherein the reduction in thickness is greater than 50%.

31. The method of claim 23 wherein the ingot or billet is forged with a reduction in thickness greater than 25%.

32. The method of claim 31 wherein the reduction in thickness is greater than 50%.

33. The method of claim 18 wherein the alloy contains less than 5% ancillary alloying additions.

34. The essentially porosity-free product formed by the method of claim 19.

35. The essentially porosity-free product formed by the method of claim 20.

36. The essentially porosity-free product formed by the method of claim 23.

* * * * *

UNITED STATES PATENT AND TRADEMARK OFFICE

CERTIFICATE OF CORRECTION

PATENT NO. : 4,104,061
DATED : August 1, 1978
INVENTOR(S) : Sidney G. Roberts

It is certified that error appears in the above-identified patent and that said Letters Patent are hereby corrected as shown below:

Column 3, line 43, "250°" should be --260°--

Column 4, Table, Under % Mg, "1.0 to" should be --1.0 to 12.0--

Column 6, line 8, "passgeways" should be --passageways--

Column 7, line 31, "800°" should be --880°--

Column 10, line 1, "and to balance" should be --and the balance--.

Signed and Sealed this

*Twenty-seventh* Day of *March 1979*

[SEAL]

*Attest:*

RUTH C. MASON
*Attesting Officer*

DONALD W. BANNER
*Commissioner of Patents and Trademarks*